US005704510A

United States Patent [19]

Feltman, III et al.

[11] Patent Number: 5,704,510

[45] Date of Patent: Jan. 6, 1998

[54] TOP LOCK LID

[76] Inventors: Charles H. Feltman, III, 2569 Marian Way; Dirk G. Langer, 519 High St., both of San Luis Obispo, Calif. 93401

[21] Appl. No.: 576,374

[22] Filed: Dec. 21, 1995

[51] Int. Cl.[6] ..... B65D 41/06

[52] U.S. Cl. ..... 220/293; 220/713; 220/703

[58] Field of Search ..... 220/703, 704, 220/710.5, 711, 713, 714, 715, 716, 718, 787, 789, 790, 800, 801, 802, 288, 293, 296, 297, 298, 301, 302, 253, 255; 215/329, 332, 387; 222/519, 548, 551, 552, 562, 563, 554, 570, 560, 561, 556, 557

[56] References Cited

U.S. PATENT DOCUMENTS 2,437,784 3/1948 Laskin ..... 220/714
2,529,114 11/1950 Tellier ..... 220/713
2,625,019 1/1953 Brown ..... 220/714
5,294,014 3/1994 Wyatt et al. ..... 220/715 X

*Primary Examiner*—Allan N. Shoap
*Assistant Examiner*—Nathan Newhouse
*Attorney, Agent, or Firm*—Pretty, Schroeder & Poplawski

[57] ABSTRACT

A mug comprising a container and a lid, with the container having an inwardly projecting seal rim and inwardly projecting retainers spaced above the seal rim. The lid has a disc for engagement with the upper surface of the seal rim with a retainer opening for passing the retainer, and a catch for positioning under the retainer to retain the lid in the container on the seal rim. The retainer may be formed integrally with the container, or may be a stud carried in an opening in the container. The catch of the lid preferably includes a flexible center with a ramp at each end joining the catch to the disc.

9 Claims, 3 Drawing Sheets

FIG. 1
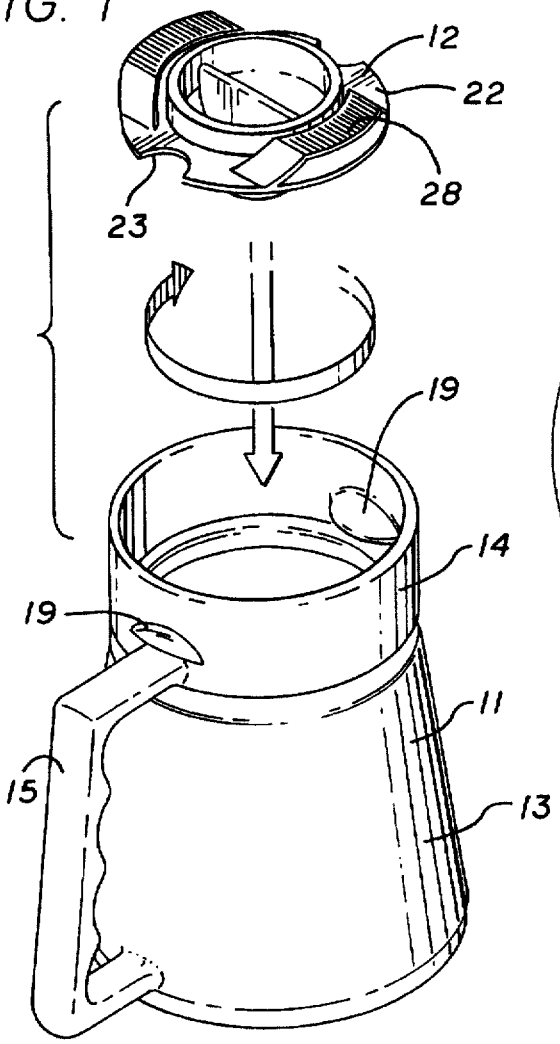
FIG. 2
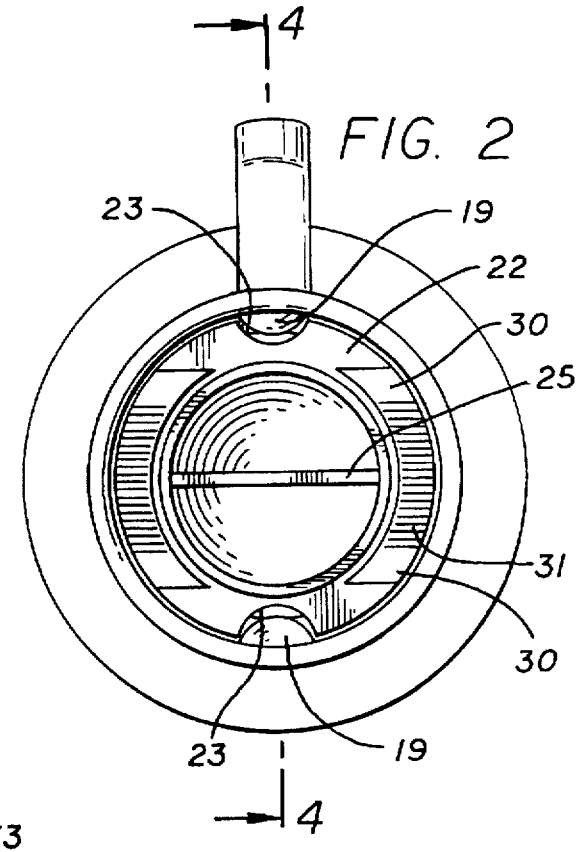
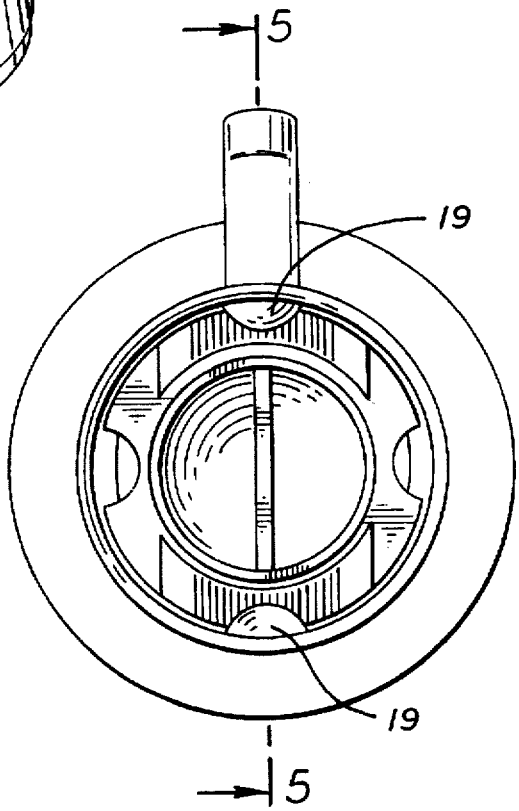
FIG. 3

FIG. 7
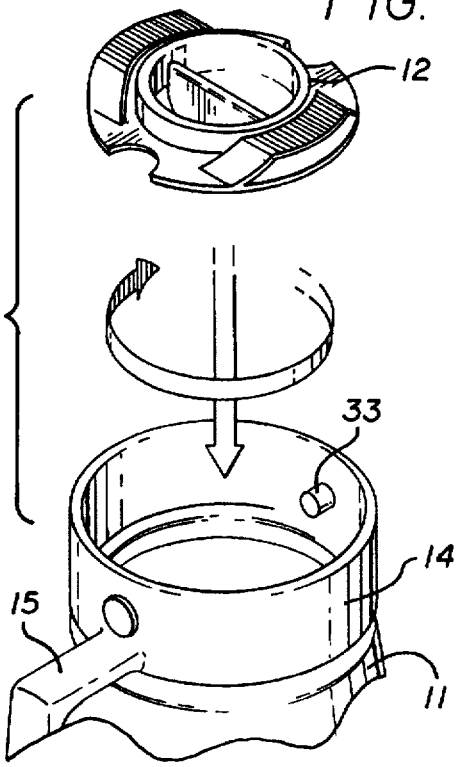
FIG. 8
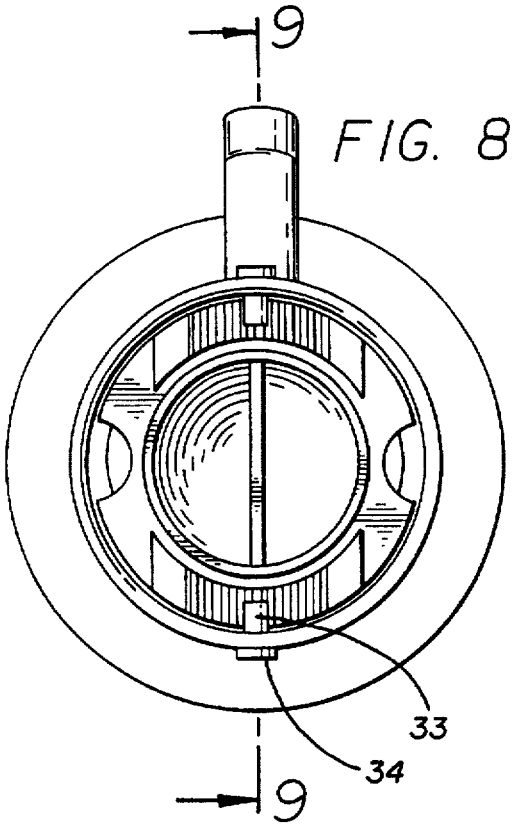
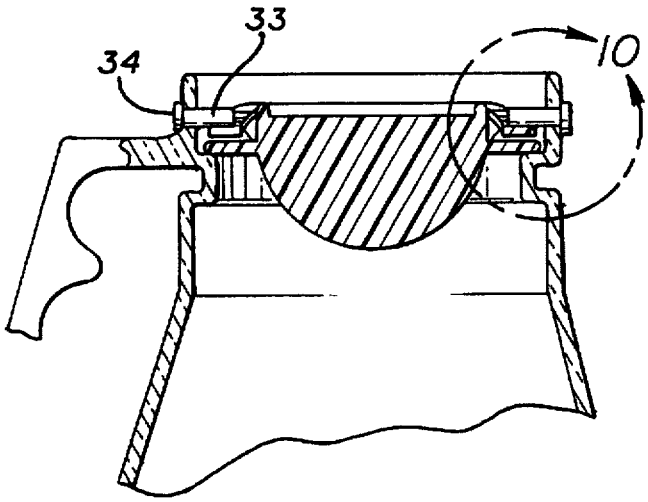
FIG. 9
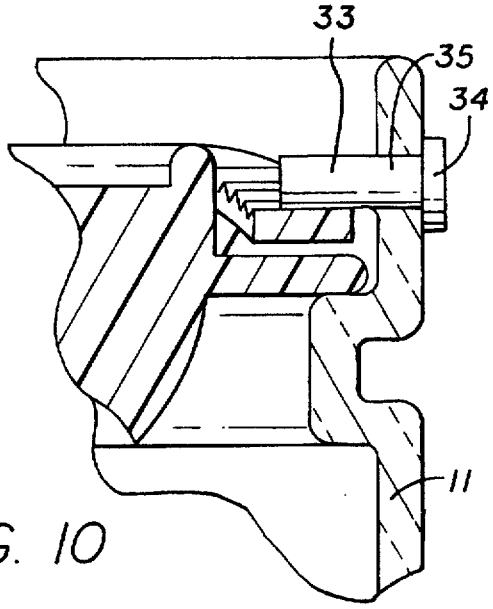
FIG. 10

TOP LOCK LID

BACKGROUND OF THE INVENTION

This invention relates to drinking mugs comprising a container and a lid, and conventional containers with lids are shown in U.S. Pat. Nos. 2,529,114; 2,358,600; 4,582,218; 5,018,636; 5,217,141; and 5,102,000.

Typically, the mugs are utilized for hot drinks such as coffee and often are made of ceramic.

Drinkers often carry mugs with a hot drink therein about with them, in the office, in the shop, and at home, and often in vehicles. Hence, some form of lid is desirable to prevent sloshing and/or spilling of the hot drink. Various problems have been encountered in the past, including leakage due to inadequate sealing pressure, and inadvertent tipping of the container when the user thought the lid was in place.

Some of the prior designs do not allow for the variability in size of the ceramic mug which makes the plastic lid either fit too loose or too tight. Also other designs incorporate projecting legs or tabs which can break off. If these legs or tabs break off while the mug is in use the user cannot see that the lid is not securely fastened and may be seriously injured when the user goes to take a drink of hot liquid and the lid falls out, allowing a greater flow of hot liquid than was expected. Because the locking mechanism of other designs is underneath the lid, the user cannot tell for certain if the lid is securely locked.

Accordingly, it is an object of the present invention to provide a new and improved mug construction which provides a compression seal between the lid and container and which also provides a visual indication to the user as to whether or not the lid is properly in place.

In the present invention, downward pressure on the lid remains constant, regardless of the variability of size of the ceramic part, providing a consistently snug fit on all parts. Also the design has no projections which may break off, bend, or become ineffective due to wear and tear.

Other objects, advantages, features and results will more fully appear in the course of the following description.

SUMMARY OF THE INVENTION

A mug comprising a container and a lid, with the container having an inwardly projecting seal rim and inwardly projecting retainer means spaced above the seal rim. The lid has a disc for engagement with the upper surface of the seal rim with a retainer opening for passing the retainer means, and a catch for positioning under the retainer means to retain the lid in the container on the seal rim.

The retainer means may be formed integrally with the container or may be a stud carried in an opening in the container.

In the preferred embodiment the catch of the lid includes a flexible center with a ramp at each end joining the catch to the disc.

BRIEF DESCRIPTION OF THE DRAWINGS

FIG. 1 is an exploded perspective view of a mug with lid positioned above the container, and incorporating the presently preferred embodiment of the invention;

FIG. 2 is an enlarged top view of the mug of FIG. 1 with the lid in the insertion position;

FIG. 3 is a view similar to that of FIG. 2 showing the lid rotated into the sealing position;

FIG. 7 is a view similar to that of FIG. 1 showing an alternative embodiment of the invention;

FIG. 8 is a view similar to that of FIG. 3, of the embodiment of FIG. 7;

FIG. 9 is a view similar to that of FIG. 5, of the embodiment of FIG. 7; and FIG. 10 is a view similar to that of FIG. 6, of the area enclosed in circle 10 in FIG. 9.

DESCRIPTION OF THE PREFERRED EMBODIMENTS

Figure 4:
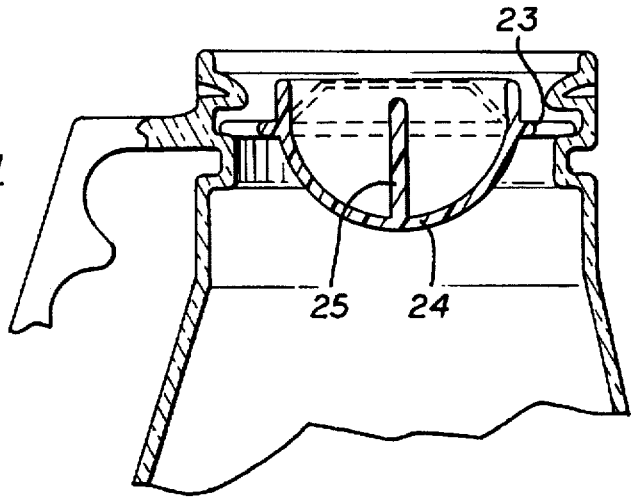
FIG. 4 is a partial sectional view taken along the line 4–4 of FIG. 2.

The mug includes a container 11 and a lid 12. The container typically is ceramic with a body 13, a neck 14 and a handle 15.

An inwardly projecting seal rim 17 is formed in the neck of the body. The seal rim includes an upper surface 18 on which the lid rests. One or more inwardly projecting retainers 19 are formed in the neck above the seal rim 17. In the embodiment illustrated in FIGS. 1–6, two opposed retainers are formed integrally with the container.

The lid 12 includes a disc 22 with one or more retainer openings 23 which provide clearance for the retainers 19, permitting placing the lid into the neck from above with the disc of the lid passing below the retainers to rest on the upper surface 18 of the seal rim.

Preferably the lid has a central hemispherical section 24 with a transverse vertical member 25 providing for grasping of the lid between the thumb and a finger of the user.

Figure 5:
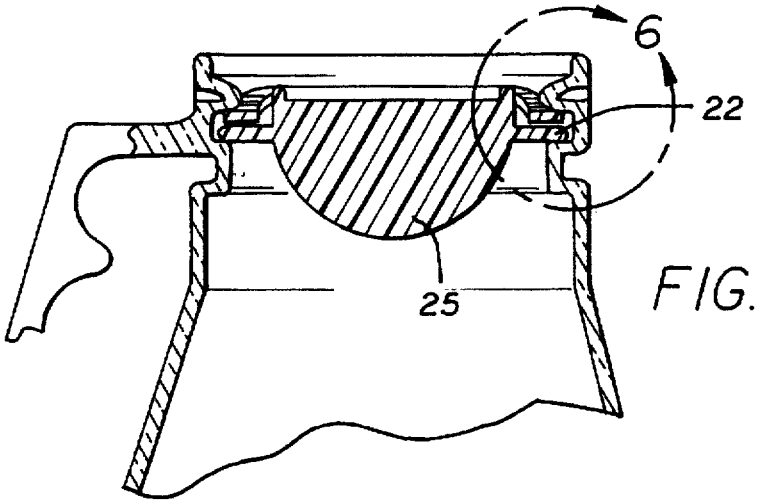
FIG. 5 is a partial sectional view taken along the line 5–5 of FIG. 3.
Figure 6:
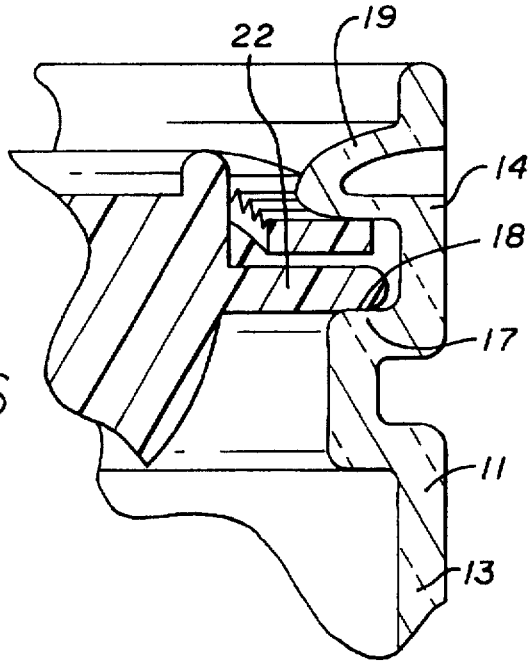
FIG. 6 is an enlarged partial sectional view of the area indicated by the circle 6 in FIG. 5.

The lid also has one or more catches 28 carried on the disc, typically a catch for each retainer of the container. The catch is designed for positioning under the retainer as shown in FIGS. 3, 5 and 6, for retaining the lid in the container and providing a pressure seal between the lid disc and the container seal rim, in the manner shown in FIG. 6.

The catch preferably has a ramp 30 joining a central section 31 of the catch to the disc 22 of the lid. In the preferred embodiment illustrated, a ramp 30 is provided at each side of the central section 31. The central section 31 is spaced up from the disc 22, with the central section being deformed downward as it passes under the retainer 19, thereby providing a downward pressure of the lid disc on the container rim upper surface, achieving the desired pressure seal. The upper surface of the central section preferably is serrated to provide a measure of locking engagement with the container retainer.

The catch may be formed integrally with the disc, or may be formed separately and joined to the disc. In either construction, the catch is made sufficiently flexible so that the catch can be moved under the container retainer as the lid is rotated from the position of FIG. 2 to the position of FIG. 3.

An alternative configuration is shown in FIGS. 7–10, where components corresponding to those of FIGS. 1–6 are identified by the same reference numerals. In this embodiment, separate studs 33 are utilized in place of the integrally molded construction to serve as the inwardly projecting retainers. The stud 33 typically is a plastic pin with an enlarged flange at one end. Openings 35 may be molded in the container 11 or bored in the container after firing. The stud is dimensioned to be a push fit in the opening 35, with the flange 34 limiting the insertion of the stud into the container. The lid construction is the same for both embodiments, with the stud functioning in the same manner as the integrally molded retainer 19 of the embodiments of FIG. 1–6.

Thus, it is seen that the desired objects of a drinking mug with a compression seal, with the condition of the seal being visually available to the user, are achieved.

We claim:

1. A mug comprising a container and a lid, said container having an inwardly projecting seal rim and inwardly projecting retainer means spaced above said seal rim, said lid having a disc for engagement with an upper surface of said seal rim with a retainer opening for passing said retainer means, and a catch for positioning under said retainer means to retain said lid in said container on said seal rim, with said catch of said lid including a flexible center with a ramp at each end joining said catch to said disc, and with said flexible center spaced above the surface of said disc.

2. The mug as defined in claim 1 wherein said retainer means is formed integrally with said container.

3. The mug as defined in claim 1 wherein said retainer means includes two oppositely positioned bosses, and with two of said catches oppositely positioned on said lid, each of said catches having a flexible center with a ramp at each end joining said catch to said disc.

4. A mug comprising a container and a lid, said container having an inwardly projecting seal rim and inwardly projecting retainer means spaced above said seal rim, said lid having a disc for engagement with an upper surface of said seal rim with a retainer opening for passing said retainer means, and a catch for positioning under said retainer means to retain said lid in said container on said seal rim, said retainer means including a stud carried in a radial opening in said container.

5. The mug as defined in claim 4 wherein said stud has an outer flange and is pushed into said radial opening in said container with said outer flange engaging a container outer wall.

6. A mug comprising a container and a lid, said container having an inwardly projecting seal rim and inwardly projecting retainer means spaced above said seal rim, said lid having a disc for engagement with an upper surface of said seal rim with a retainer opening for passing said retainer means, and a catch for positioning under said retainer means to retain said lid in said container on said seal rim, said catch of said lid including a flexible center with a ramp at each end joining said catch to said disc, with said center having a serrated upper surface.

7. A lid for a mug having an inwardly projecting seal rim and inwardly projecting retainer means spaced above said seal rim, said lid having a disc for engagement with an upper surface of said seal rim with a retainer opening for passing said retainer means, and a catch for positioning under said retainer means to retain said lid in said container on said seal rim, said catch of said lid including a flexible center with a ramp at each end joining said catch to said disc, and with said center having a serrated upper surface.

8. The lid as defined in claim 7 wherein said flexible center is spaced above said disc.

9. The lid as defined in claim 7 wherein said retainer means includes two oppositely positioned bosses, and with two of said catches oppositely positioned on said lid, each of said catches having a flexible center with a ramp at each end joining said catch to said disc.

* * * * *